US005144937A

United States Patent [19]

Colvin

[11] Patent Number: 5,144,937

[45] Date of Patent: Sep. 8, 1992

[54] ARCHERY BOW ARROW REST

[75] Inventor: Richard O. Colvin, Baldwinsville, N.Y.

[73] Assignee: Kinetronic Industries, Inc., Media, Pa.

[21] Appl. No.: 524,219

[22] Filed: May 4, 1990

[51] Int. Cl.[5] ..... F41B 5/00

[52] U.S. Cl. ..... 124/44.5; 124/24.1

[58] Field of Search ..... 124/23.1, 24.1, 44.5, 124/88

[56] References Cited

U.S. PATENT DOCUMENTS

| | | | |
|---|---|---|---|
| 2,998,811 | 9/1961 | Sackmann | 124/24.1 |
| 3,059,631 | 10/1962 | Yasho | 124/44.5 |
| 4,380,226 | 8/1983 | Saunders | 124/44.5 |
| 4,398,528 | 8/1983 | Troncoso | 124/44.5 X |
| 4,476,846 | 10/1984 | Carville | 124/44.5 |
| 4,646,093 | 5/1987 | Nunemaker | 124/44.5 X |
| 4,715,355 | 12/1987 | Lattig | 124/44.5 |
| 4,756,295 | 7/1988 | Guzzetta | 124/44.5 X |
| 4,809,670 | 5/1989 | Simo | 124/24.1 |
| 4,838,237 | 6/1989 | Cliburn | 124/24.1 X |
| 4,865,007 | 9/1989 | Saunders | 124/88 X |
| 4,890,596 | 1/1990 | Barlow | 124/44.5 |
| 4,947,823 | 8/1990 | Larson | 124/24.1 X |
| 4,953,521 | 9/1990 | Troncoso et al. | 124/44.5 X |
| 5,031,601 | 7/1991 | Gunter | 124/24.1 X |

OTHER PUBLICATIONS

Bow and Arrow, Jun. 1982, p. 41.
Cabela's, Fall 1989, p. 131.

*Primary Examiner*—Randolph A. Reese
*Assistant Examiner*—Jeffrey L. Thompson
*Attorney, Agent, or Firm*—D. Peter Hochberg; Mark Kusner; Louis J. Weisz

[57] ABSTRACT

An archery bow arrow rest having a pivotal support arm biased to support an arrow on its free end. At right angles to its free end, the support arm has a fixed end positioned in, and attached to a bushing. The bushing passes through and is rotatable in a mounting bracket connecting the arrow rest to the bow. The bushing is also encircled by an arm-biasing coil spring, one end of which is anchored to the bracket, and the other end to a torque-controlling knob adjustably attachable to the bushing. The knob encircles the spring, thereby enclosing and protecting it from dirt. In a preferred embodiment, the free end of the support arm has a circular member attached to it on which the arrows are placed, and which provides quiet, low-friction launches of arrows. Through its gradual rotation, the member distributes arrow-induced wear on the member evenly over its surface.

9 Claims, 3 Drawing Sheets

ARCHERY BOW ARROW REST

TECHNICAL FIELD

This invention relates to improved archery equipment that provides more accurate and consistent shooting. More particularly, this invention relates to an arrow rest for an archery bow that dampens distortions imposed on arrows during their launch from the bow. Specifically, this invention relates to an arrow rest for an archery bow whose arrow-supporting arm has a biasing force applied thereto by means of an enclosed adjustable spring that permits the magnitude of the force to be varied to accomodate use of the rest with arrows possessing different physical characteristics, including weight. In preferred embodiments of the invention, the support arm on which arrows are placed during the shooting process is provided with a long-wearing, rotatable element that reduces friction between the rest and arrows with which it comes into contact.

BACKGROUND OF THE INVENTION

Mankind has employed the archery bow for thousands of years, not only as a weapon, but for hunting purposes and for engaging in target shooting. While no longer used in warfare, the bow is still extensively used in hunting and for target shooting, both kinds of activities requiring a high order of accuracy for success and enjoyment. As will be readily understood, the achievement of shooting accuracy requires the exercise of a variety of skills including such things as concentration, shooting form, the ability to correctly estimate windage and distance, as well as other abilities.

Also important, however, is the nature of the equipment employed by the archer, and in this regard, it is essential that all components making up the archery equipment be in precise adjustment if maximum results are to obtained.

Although as indicated, archery has long been practiced, archery equipment has become relatively sophisticated over the years, due to the intense interest in excelling on the part of those engaged in the sport. Thus, common archery accessories now include such things as peep sights, adjustable metal string nocks, stabilizing arrow rests and cushion plungers, and a host of other similar features.

With respect to arrow rests, such devices are attached to the handle of the bow to provide support for arrows placed on the rest during shooting so that instability due to the forces imposed on the arrows by the bow string during the act of launch can be dampened. Such rests commonly consist of arms of various shapes, positioned parallel to the longitudinal axis of the arrows placed thereon. Some of the rests are spring-loaded to provide a restorative force capable of correcting arrow deflection during launch resulting from the forces referred to above. In this regard, at the moment of release of an arrow, the force imposed by the string propelling the arrow tends to deflect it causing the arrow to bow along its longitudinal axis. The biasing force of the spring serves to counteract and dampen vertical distortions of the arrow, providing it with accuracy-enhancing stability. Frequently, a spring loaded device termed a "cushion plunger" is positioned against one side of the arrow to furnish a biasing force that promotes stability of the arrow in the horizontal plane.

While contributing to flight accuracy, many arrow rests of the type described have heretofore had the disadvantage of being specific to the physical characteristics of arrows with which they were used. In this regard, depending upon their intended use, arrows are fabricated from a variety of materials, in various lengths and diameters, and they often have widely varying weights. For example, hunting arrows, commonly range from a weight of about 350 grains to about 700 grains, while fishing arrows of up to about 2000 grains are not unknown. While such diversity assures the shooter of the best arrow for the intended purpose, it forces a compromise in selecting a spring to generate the force required to satisfactorily bias the arrow rest. In other words, with a particular spring, the arrow rest exerts an optimal biasing force for a particular type of arrow, thus necessitating the substitution of springs having different force values to accomodate shooting style preferences, and changes of arrows.

Furthermore, in the rare instance where some force adjustability of the spring has been provided, the spring has been mounted in an exposed position, making it vulnerable to disabling accumulations of dirt and debris and otherwise encouraging functional interference.

A further disadvantage of arrow rests of the type described is that over time, their continued frictional contact with arrows launched over them gradually results in wear of the arrow rest surface contacted by the arrows during launch. Such wear is disadvantageous in that it can adversely influence positioning of the arrow on the rest and otherwise interfere with the arrow's flight dynamics.

BRIEF DESCRIPTION OF THE INVENTION

In view of the preceding, therefore, it is a first aspect of this invention to provide an improved arrow rest for an archery bow.

A second aspect of the arrow rest of this invention is to permit the quiet, low-friction launch of arrows therefrom.

A still further aspect of this invention is to provide better support, guidance, and flight accuracy to arrows used therewith.

Yet another aspect of this invention is to provide an arrow rest that can be used with arrows possessing different physical characteristics.

A further aspect of this invention is to furnish an arrow rest with an enclosed adjustable biasing spring.

Another aspect of this invention is to make available an arrow rest that allows controlled torque adjustments to be made to its support arm.

An additional aspect of this invention is to furnish an arrow rest that improves consistency by providing uniform wear to certain parts thereof.

The foregoing and additional aspects of the invention are provided by an arrow rest for an archery bow comprising: a support arm; adjustable, enclosed spring means; and attachment means, said support arm having a free end and a fixed end, and being pivotal in an arc about said fixed end, wherein said fixed end is adapted for attachment to said bow by said attachment means, and said fixed end is connected to said spring means, said spring means exerting an adjustable biasing force on said support arm that serves to dampen the shock imposed by the release of arrows positioned on said rest from said bow.

The foregoing and still additional aspects of the invention are provided by an arrow rest for an archery bow comprising: a support arm; a coil spring; a torque-adjusting knob; a bushing; and a mounting bracket, said support arm having a free end and a fixed end, and being pivotal in an arc about said fixed end, said bracket being adapted for mounting on said bow, and said fixed end of said support arm passing through said bushing and being connectable thereto, said bushing passing through and being free to rotate in said bracket and passing into said knob to which it is adjustably connectable, while said spring is positioned between said knob and said bushing with one of its ends anchored in said bracket and its other end anchored in said knob, whereby said knob can be rotated until sufficient tension is created in said spring and thereupon fastened to said bushing, thereby providing the desired biasing force on said support arm.

The foregoing and other aspects of the invention are provided by an arrow rest for an archery bow comprising: a support arm; a teflon roller member; and adjustable, enclosed spring means, said support arm having a free end and a fixed end and being rotatable in an arc, said fixed end being adapted for attachment to said bow, and said roller member being mounted on said free end parallel to its longitudinal axis and rotatable thereabout, said fixed end being connected to said spring means so as to allow said spring means to produce an adjustable biasing force on said support arm that serves to dampen the shock imposed on arrows positioned on said rest and shot from said bow, and the incremental rotation of said roller caused by the placement of sequential arrows thereon resulting in the presentation of different peripheral surfaces of said roller to sequential arrows, thereby providing more uniform wear of the roller.

The foregoing and still other aspects of the invention are furnished by an archery bow provided with an arrow rest according to the preceding paragraphs.

BRIEF DESCRIPTION OF THE DRAWINGS

The invention will be better understood when reference is had to the following drawings, in which like numbers refer to like parts, and in which.

DETAILED DESCRIPTION OF THE INVENTION

Figure 1:
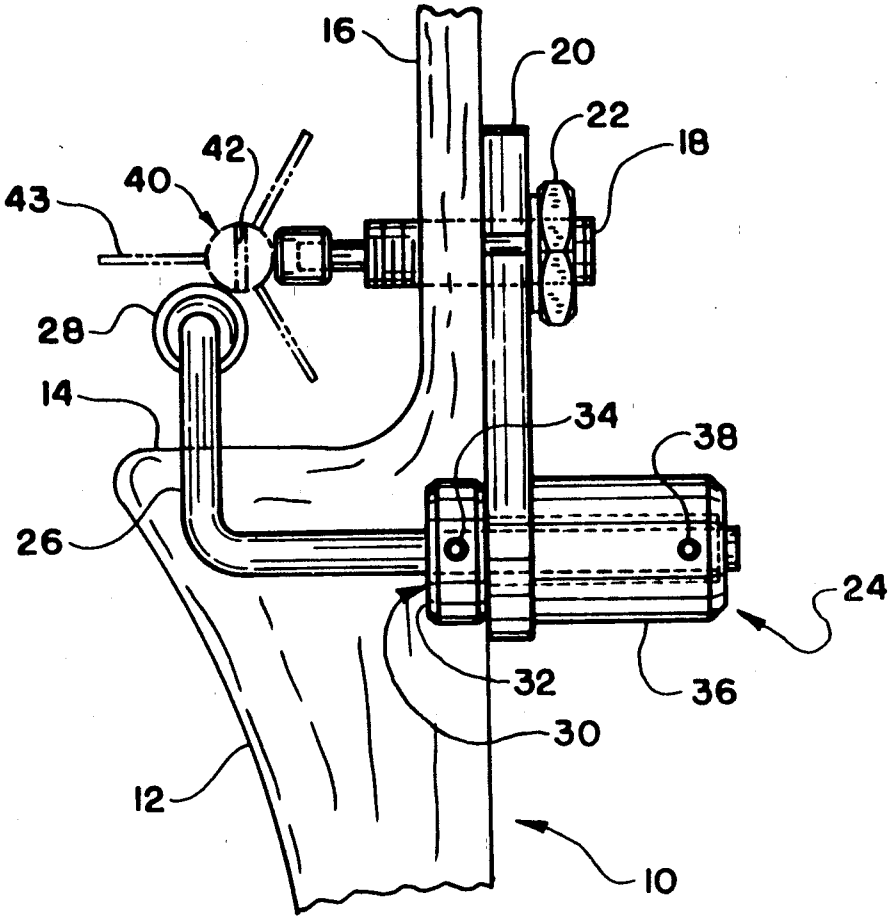
FIG. 1 is a rear elevation of an arrow rest of the invention mounted on a bow by means of a cushion plunger assembly.

FIG. 1 is a rear elevation of an arrow rest of the invention, generally 24, mounted on a bow by means of a cushion plunger 18. In the figure, a mounting bracket side plate 20 is attached to a side wall riser 16 of the bow 10 by means of a cushion plunger 18, which is threadably engaged with the side wall riser and held there by means of a locknut 22. As shown, the cushion plunger 18, which is spring loaded, contacts an arrow, generally 40, resting on roller 28 which constitutes part of the arrow rest. The arrow 40 is automatically positioned by alignment of its nock 42 so that its arrow fletches 43 lie unobstructed over shelf 14 of the bow. Roller 28 is attached to support arm 26, which in turn extends through a bushing member, generally 30, only the shoulder 32 of which is visible in the figure. The bushing 30 is secured to support arm 26 by means of a locking set screw 34 extending through the bushing shoulder 32. Bushing 30 passes through the lower end of the mounting bracket side plate 20, near the top of the riser grip 12. A torque adjustment knob 36 is secured to the bushing by means of a torque knob locking set screw 38.

To install the arrow rest 24, the mounting bracket side plate 20 is installed on the riser 16 so that the roller 28 is parallel to the shaft of the arrow 40 when the side plate is locked down by tightening locknut 22. Locking set screw 34 is then loosened and the support arm 26 is moved to the left or right, as required, to properly position arrow 40 so that it is held by the roller 28 and the cushion plunger 18. Once the proper lateral position of the support arm has been achieved, the locking set screw 34 is tightened, securing the bushing 30 to the support arm. Thereafter, an arrow is placed upon the roller 28 and observed. If the arrow tilts down, the support arm tension is increased, a process accomplished by loosening the torque knob locking set screw 38 and rotating the torque adjustment knob 36 by an incremental turn. The disposition of the arrow is reexamined and, if required, suitable readjustment of the tension is made by appropriate readjustment of the torque adjustment knob. When the support arm biasing torque is properly adjusted, the arrow will not drop down or fall off when the bow is drawn or shaken.

As is apparent from the figure, the cushion plunger 18 serves to stabilize the arrow 40 in the horizontal plane, while the roller 28 responds to the need for vertical stabilization.

While the dimensions of the arrow rest will depend upon the dimensions of the bow, the preferences of the shooter, and like considerations, it has been found of advantage to employ a support arm whose free end, or roller end, as measured from its tip to the point at which it is bent at substantially right angles to pass through bushing 30 is from about 1 to 2½ inches. The length of the fixed end, that is from the right angle bend referred to, to the end opposite the free end will conveniently be from about 1 inch to 2 and ½ inches.

Figure 2:
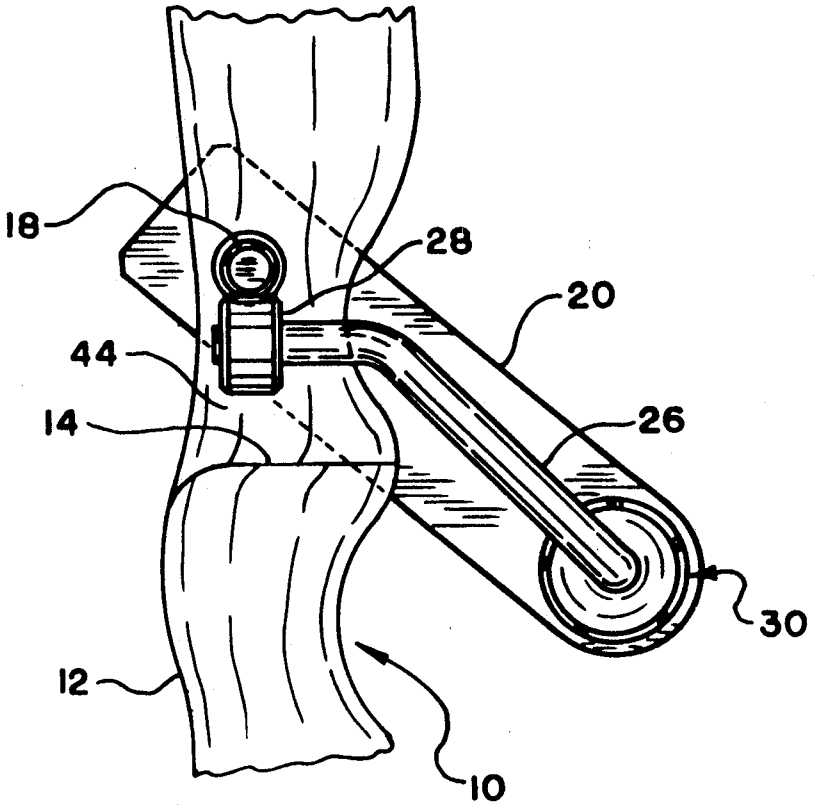
FIG. 2 is a left side elevation of the arrow rest of FIG. 1.

FIG. 2 is a side elevation of the arrow rest of FIG. 1, but without an arrow positioned thereon. As illustrated, the mounting bracket side plate 20 is attached to the side wall riser of the bow 10 by the cushion plunger 18. When so attached, the free end of the support arm 26, with roller 28 disposed thereon and free to rotate thereabout, is positioned in the "window area" of the bow 44 above the shelf 14 at the top of the riser grip 12. When so positioned, the support arm 26 is free to pivot in a limited vertical arc about bushing 30 as a result of the forces imposed by the arrow placed thereon.

Desirably, the metal support arm 26 will have a diameter of from about ⅛ to about 3/16 inch, resulting in sufficient rigidity to resist inadvertent bending of the arm which might otherwise adversely affect shooting consistency.

The roller 28, being free to rotate about the axis of the free end of support arm 26 rotates slightly whenever an arrow is placed thereon or released thereover. This results in sequential arrows being presented with fresh surfaces of the roller, distributing the wear evenly about the roller as it is used. Thus, the roller's cylindrical shape is maintained and uniformity of arrow release dynamics assured.

In view of the fact that a quiet, as well as low-friction launch is desirable, particularly when hunting game, the use of a roller made from plastic is preferred. However, due to the frictional heat generated during the launch, and the tendency of such heat to cause deterioration of the plastic as for example by softening its surface, a high melting material such as tetrafluoroethylene is preferred. Such materials are sold under the trademark TEFLON.

Figure 3:
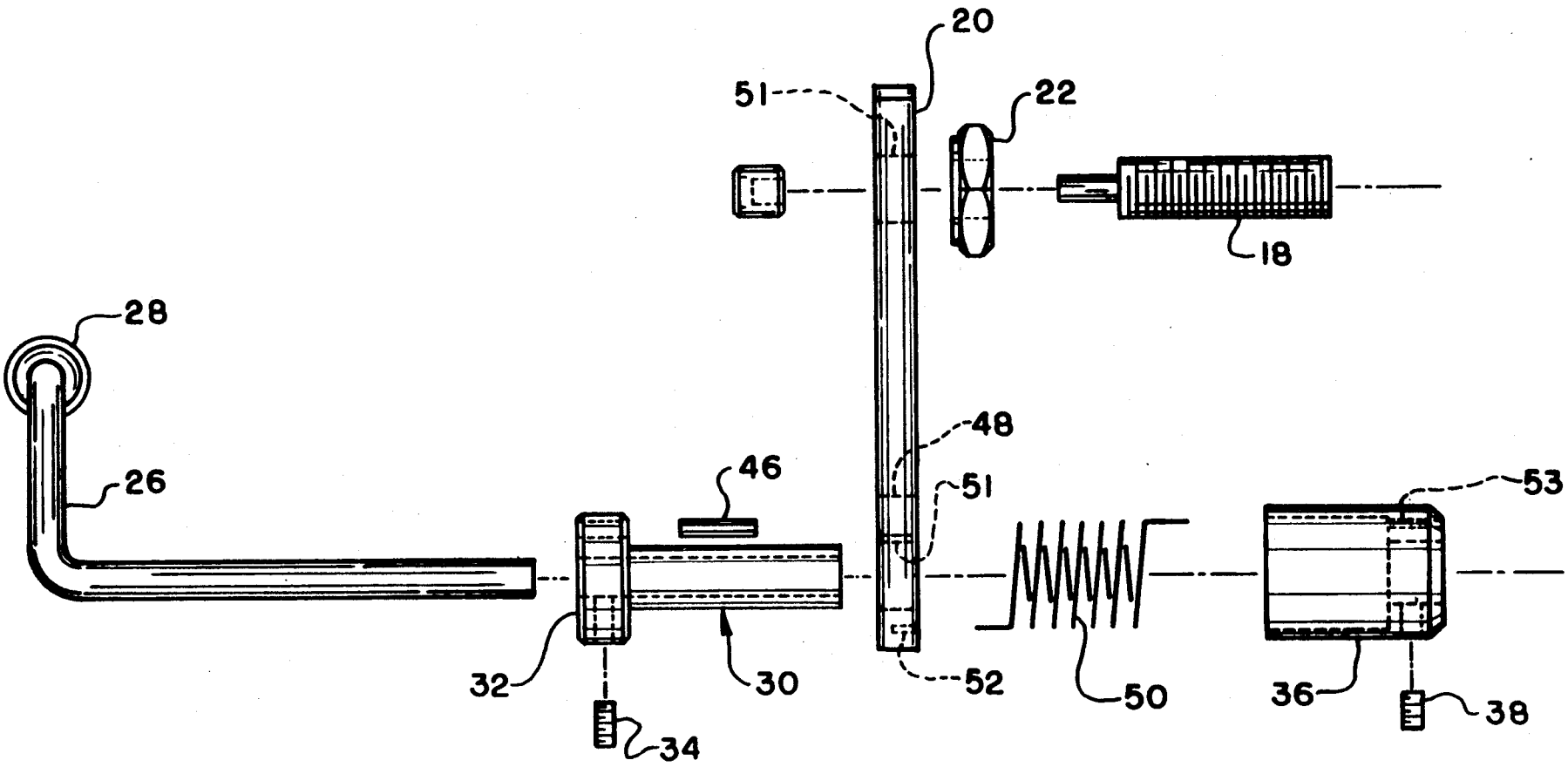
FIG. 3 is an exploded view of an arrow rest of the invention, including a cushion plunger mounting assembly.

FIG. 3 is an exploded view of an arrow rest of the invention including a cushion plunger mounting assembly.

In the figure, a support arm 26 is shown with a roller member 28 positioned thereon. The roller member may be held on the support arm by any suitable means, for example, with a "snap-ring", by a threaded fastener, or by equivalent means. The support arm includes the free end where the roller is positioned, as well as a "fixed end", opposite the free end. The fixed end is designed for insertion through bushing 30, where it is fastened by means of the locking set screw 34 extending through the bushing shoulder 32. Also inserted in shoulder 32 is a pivot pin 46, adapted to be received into a pivot limit hole 48 in mounting bracket side plate 20. The pivot pin limits the movement of the bushing, and therefore of the support arm 26 by its contact with the edges of the pivot limit hole 48. A further function of the pivot pin 46 and the pivot limit hole 48 is that such a movement-limiting system automatically brings the roller-mounted free end of the support arm into its proper original register or position. The bushing 30 is adapted to pass through access hole 51 into the interior of coil spring 50. Coil spring 50 is anchored at one end by the spring anchor hole 52 in the side plate 20, and at the other end by spring anchor hole 53 located in the torque adjustment knob 36. The torque adjustment knob fits over the end of bushing 30 where it is secured by torque knob locking set screw 38. Spring 50 is, therefore, protectably enclosed between the bushing 30 and the torque adjustment knob 36. This is a great advantage since it permits the spring to retain its lubrication and it eliminates contamination of the spring by dirt and debris which would otherwise interfere with the maintenance of the torque provided by the spring.

The mounting bracket side plate 20 is fastened to the bow by means of cushion plunger 18 passed through the plate into a threaded hole in the side wall riser adapted to receive it, being locked in such position by locknut 22.

It will be appreciated that the biasing force obtained by arrow rest of the invention is infinitely variable, as opposed to being limited to incremental variations of the type obtained when springs of different stiffness are employed, as in the prior art devices.

Figure 4:
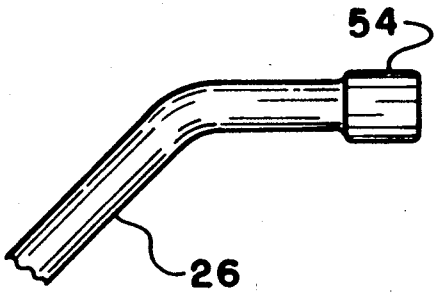
FIG. 4 is a partial side elevation of an arrow support arm provided with a cylindrical nub as an arrow support.

FIG. 4 is a partial side elevation of a support arm provided with a cylindrical "nub" as an arrow support. As shown in the figure, the nub 54 which forms the tip of the free end of support arm 26, has a substantially cylindrical shape with a diameter greater than the portion of the support arm immediately adjacent thereto. While not as desirable in some respects as the embodiments in connection with the preceding Figures, for example in being more prone to wear at one point of its surface, such wear is moderated by the fact that the point where contact occurs comprises only single point contact, since it involves the contact of a circular object against another circular object. Furthermore, in this embodiment of the invention, the material of preference is stainless steel, a hard metal that resists wear well. The advantage of the nubbed embodiment shown in the figure is that the nub can be physically bent to a position of preference for the shooter.

Figure 5:
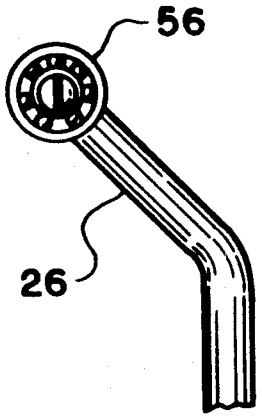
FIG. 5 is a partial side elevation of an arrow support arm provided with a ball bearing-mounted wheel.

FIG. 5 is a partial side elevation of a support arm provided with a ball bearing-mounted wheel. In prior art devices employing support wheels rotatable in a plane parallel to the arm, the slightest malfunction or resistance to rotation encourages greater wear of the rest, and therefore flat spotting. The embodiment of the invention shown in FIG. 5 overcomes the problem through the use of a wheel mounted on ball bearings. In the figure, the ball bearing-mounted wheel 56 is mounted on the free end of a support arm 26. The wheel can be fabricated from either metal or plastic; however, in a preferred embodiment, a Teflon material is employed since it produces a more silent launch of the arrow and is resistant to frictional heat as previously described.

Figure 6:
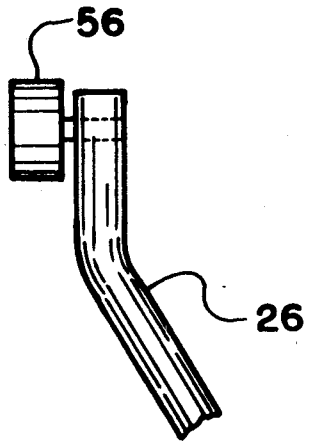
FIG. 6 is a front view of the arrow support arm of FIG. 5.

FIG. 6 is a front view of the support arm of FIG. 5 showing the ball bearing-mounted wheel 56 attached to the free end of a support arm 26. The surface of the wheel shown in FIG. 6 is smooth; however, it can be notched around its periphery, or have some other equivalent shape adapted to engage the surface of the arrow more securely, thus providing better support for the arrow.

While in accordance with the patent statutes, a preferred embodiment and best mode has been presented, the scope of the invention is not limited thereto, but rather is measured by the scope of the attached claims.

What is claimed is:

1. An archery rest for an archery bow comprising:

a support arm;

adjustable, enclosed spring means; and attachment means, said support arm having a free end and a fixed end, and being pivotal in an arc about said fixed end, wherein said fixed end is adapted for attachment to said bow by said attachment means, and said fixed end is connected to said spring means, said spring means exerting an adjustable biasing force on said support arm and serving to dampen the shock imposed by the release of arrows positioned on said rest from said bow.

wherein a tip of said free end comprises a substantially round shape having a diameter greater than the portion of said support arm immediately adjacent thereto, said arrow rest further including rotation means mounted on said free end, said rotation means being rotated by the placement of arrows thereon, wherein said rotation means permits a relatively quiet, low-friction launch of arrows from said rest.

2. An arrow rest according to claim 1 wherein said means is a tetrafluoroethylene roller mounted on said free end that is rotatable about an axis parallel to the longitudinal axis of said free end.

3. An arrow rest for an archery bow comprising:

a support arm;

adjustable, enclosed spring means; and attachment means, said support arm having a free end and a fixed end, and being pivotal in an arc about said fixed end, wherein said fixed end is adapted for attachment to said by said attachment means, and said fixed end is connected to said spring means, said spring means exerting an adjustable biasing force on said support arm that serves to dampen the shock imposed by the release of arrows positioned on said rest from said bow, wherein said arrow rest includes rotation means mounted on said free end, said rotation means being rotatable by the arrows placed thereon, wherein said rotation means permits a relatively quiet, low-friction launch of arrows from said rest, and wherein said rotation means is a ball bearing mounted wheel connected to said free end that is rotatable about an axis perpendicular to the longitudinal axis of said free end.

4. An arrow rest for an archery bow comprising:

a support arm;

a coil spring;

a torque-adjusting knob;

a bushing; and a mounting bracket, said support arm having a free end and a fixed end, and being pivotal in an arc about said fixed end, said bracket being adapted for mounting on said bow, and said fixed end of said support arm passing through said bushing and being connectable thereto, said bushing passing through and being free to rotate in said bracket and passing into said knob to which it is adjustably connectable, while said spring is positioned between said knob and said bushing with one of its ends anchored in said bracket and its other end anchored in said knob, whereby said knob can be rotated until sufficient tension is created in said spring and thereupon fastened to said bushing, thereby providing the desired biasing force on said support arm.

5. An arrow rest according to claim 4 in which said bushing is provided with a cylindrical shoulder at one end thereof.

6. An arrow rest according to claim 5 having a pin attached to said shoulder and extending into a hole in said bracket, whereby pivoting of said support arm is limited by the contact of said pin with the edges of said hole.

7. An arrow rest according to claim 4 in which said adjusting knob is connectable to said bushing and said bushing is connectable to said support arm by means of set screws.

8. An arrow rest according to claim 4 in which said bracket is mounted to said bow by means of a cushion plunger assembly.

9. An arrow rest for an archer bow comprising:

a support arm;

a tetrafluoroethylene roller member; and adjustable, enclosed spring means, said support arm having a free end and a fixed end and being rotatable in an arc, said fixed end being adapted for attachment to said bow, and said roller member being mounted on said free end parallel to its longitudinal axis and rotatable thereabout, said fixed end being connected to said spring means so as to allow said spring means to produce an adjustable biasing force on said support arm that serves to dampen the shock imposed on arrows positioned on said rest and shot from said bow, and the incremental rotation of said roller caused by the placement of sequential arrows thereon resulting in the presentation of different peripheral surfaces of said roller to sequential arrows, thereby providing more uniform wear of the roller.

* * * * *